US008277299B2

(12) United States Patent
Ditchev

(10) Patent No.: US 8,277,299 B2
(45) Date of Patent: Oct. 2, 2012

(54) CASINO SLOT WAGERING SYSTEM

(76) Inventor: Dimo Ditchev, Reno, NV (US)

( * ) Notice: Subject to any disclaimer, the term of this patent is extended or adjusted under 35 U.S.C. 154(b) by 734 days.

(21) Appl. No.: 12/454,901

(22) Filed: May 26, 2009

(65) Prior Publication Data

US 2010/0304817 A1 Dec. 2, 2010

(51) Int. Cl.
*A63F 9/24* (2006.01)

(52) U.S. Cl. ..... 463/13; 463/9; 463/11

(58) Field of Classification Search ..... 463/9, 11, 463/13
See application file for complete search history.

(56) References Cited

U.S. PATENT DOCUMENTS

| | | | |
|---|---|---|---|
| 4,743,022 | A | 5/1988 | Wood |
| 5,294,120 | A | 3/1994 | Schultz |
| 5,332,228 | A | 7/1994 | Schultz |
| 5,356,140 | A | 10/1994 | Dabrowski |
| 5,401,023 | A | 3/1995 | Wood |
| 5,531,440 | A | 7/1996 | Dabrowski |
| 5,823,873 | A | 10/1998 | Moody |
| 5,868,618 | A | 2/1999 | Netley |
| 6,007,066 | A | 12/1999 | Moody |
| 6,050,568 | A | 4/2000 | Hachquet |
| 6,098,985 | A | 8/2000 | Moody |
| 6,343,989 | B1 | 2/2002 | Wood |
| 6,503,145 | B1 | 1/2003 | Webb |
| 6,511,070 | B1 | 1/2003 | Daines |
| 6,517,074 | B1 | 2/2003 | Moody |
| 6,561,898 | B2 | 5/2003 | Moody |
| 6,565,432 | B2 | 5/2003 | Moody |
| 6,568,680 | B1 | 5/2003 | Moody |
| 6,569,013 | B1 | 5/2003 | Taylor |
| 6,612,927 | B1 | 9/2003 | Slomiany |
| 6,638,163 | B2 | 10/2003 | Moody |
| 6,739,970 | B2 | 5/2004 | Luciano |
| 6,780,104 | B2 | 8/2004 | Fox |
| 6,786,824 | B2 | 9/2004 | Cannon |
| 6,817,614 | B2 | 11/2004 | Ibbertson |
| 6,824,467 | B2 | 11/2004 | Schlottmann |
| 6,878,060 | B2 | 4/2005 | Moody |
| 6,884,168 | B2 | 4/2005 | Wood |
| 6,913,531 | B1 | 7/2005 | Yoseloff |
| 7,059,965 | B2 | 6/2006 | Jackson |
| 7,137,628 | B2 | 11/2006 | Moody |
| 7,156,397 | B2 | 1/2007 | Moody |
| 7,172,198 | B2 | 2/2007 | Parham |
| 7,380,795 | B2 | 6/2008 | Novellie et al. |
| 2005/0085285 | A1* | 4/2005 | Muskin ..... 463/13 |

* cited by examiner

*Primary Examiner* — Bradley K Smith
(74) *Attorney, Agent, or Firm* — Knechtel, Demeur & Samlan

(57) ABSTRACT

A new concept for designing casino slot games The game links together more than one game through their bets and their outcomes. All the bets and outcomes form a multidimensional matrix. A computer calculates the probabilities of all bets and outcomes during the betting rounds in real time. As a result of the so chained slot games the player makes decisions in multiple betting rounds in insufficient information about the game outcomes. At any time during the game play the player can evaluate the game outcomes as presented to him by the computer and raise his bet, proceed to the next betting round without changing the bet, or simply finish the game with no penalty.

22 Claims, 13 Drawing Sheets

CASINO SLOT WAGERING SYSTEM

BACKGROUND OF THE INVENTION

The history of slot machines as amusement devices dates back to 1897 when Charlie Fey, a car mechanic from San Francisco, invented "Liberty Bell". He used it to entertain his customers while they were waiting for their cars being repaired at his shop. Several new companies, by making mechanical slot machines with similar design, gave the birth of a new fast growing industry. But the gambling aspect of these gambling primates was limited due to the physical limitation on the number of symbols and fairly easiness to cheat, therefore the rather small jackpots.

In 1964 the slot machines turned into a business device also. By replacing the mechanical parts of the slot machine with electronic parts Bally Manufacturing added two more dimensions to slot machines: the coins in and coins out. Unlike their mechanical counterparts the computers were no subject to wear and tear. The results from their operation became highly reliable and predictable. From fringe pastime offering placed around the edges of the casinos for the companions of the gamblers while they were playing at the tables, the slot machines were moved to the center of the casino. By the mid 70's they dominated the casinos by generating about three quarters of the casino revenue.

Video poker became very popular as a slot game in the late 70's. The dimension of the optimal play was added. Players were able to make decisions and chose among different alternative strategies. Its popularity grew so much in the early 90's that earned it the name the "America's National Game of Chance".

The progressive systems in the 80's added another dimension to the slot machines by virtually linking many slot machines very often in different casinos and physical areas into one common pool. By playing at any one of these slot machines the players were contributing a dismal portion of their bet into a jackpot with unperceivable before size and were competing for it. The technological innovations in the computer science elevated the physical restriction in the size of the reels and provided analyses on the outcomes by computer simulation.

The design of the multi-game in the early 90's gave the player the ability to choose among different games at the same slot machines and added multiple dimensions to the slot machines. Now the same slot machine was also a poker machine, a keno machine, you name it. The slot machine was turned into a virtual multidimensional gaming device.

By linking two consecutive games into one game the bonus games added yet another equation to the problem. Now the slot machines are linked both in space and time.

The Indian gaming expanded the social dimension to the slot machines on a national scale. Now not just Nevada but the whole nation uses the slot machine as tool to aggregate disposable income and allocates it to solve community issues.

SUMMARY OF THE INVENTION

The novelty of the approach in this new game design is, that in contrast to the traditional casino slot games the player is offered a series of betting rounds in a slot game based on the computer evaluation or processing of precompiled data in real time to the dynamically changing real probabilities of the game outcomes and associating awards to them. Also considering some established paradigms in the gaming industry, at any time during the game the player can engage into the betting round, skip and proceed to the next betting round, or be able to exit the game without any penalty.

The 21st century marked an explosion in technological innovation and information. This created a challenging environment for every one of us in making decisions every day of our lives in imperfect information. As information changes throughout the course of an execution, we have to reevaluate our initial decision and take appropriate actions to improve our performance.

The current invention is aimed to provide a method for designing casino slot game that will match our environment. The current innovative game design links together more than one game through their bets and their outcomes. If we arrange the bets of more than 2 games in the rows of a table and the outcomes in the columns of the table, we will obtain a multidimensional matrix as far as the games have some common bets and some common outcomes (In this invention we are not going to discuss the subclass of diagonal matrixes as they don't present any interest to us). Next with a computer we calculate the probabilities of all bets and outcomes in the table in real time. By real time we mean that the computer is either dynamically solving the so formed matrix with methods of the mathematical optimization, or simply retrieving the data from previously created and statically stored tables. In both case we can derive and use parameterized approximation functions in well-behaved subsections of the matrix, either to speed up the calculations, or reduce the size of the tables, hence increase the speed also. As the player is receiving additional information in the course of the game, he has to make decision in each betting round based on future events that will be revealed later in the game, which is defined as insufficient information.

For better illustration of the idea we will use a basic example. A player tosses a dollar coin in a casino. If he gets tails, he loses his dollar, if he gets heads, the casino pays him $0.95. Let's now try to improve the game. The player can toss two $1 coins. If both are tails, he loses them, if 1 is heads, he gets $0.95, if both are heads, he gets $1.90. We can describe the so designed game in the following table:

| | 0 | 0.95 | 0.95 | 1.9 |
|---|---|---|---|---|
| 1st coin | T (0.25) | H (0.25) | T (0.25) | H (0.25) |
| 2nd coin | T (0.25) | T (0.25) | H (0.25) | H (0.25) |

Legend:
T = tails
H = heads

And the probabilities will look like:

| Probabilities | Pays | Percent |
|---|---|---|
| 0.5 × 0.5 = 0.25 | 0 | 0.00% |
| 0.5 × 0.5 = 0.25 | 0.95 | 23.75% |
| 0.5 × 0.5 = 0.25 | 0.95 | 23.75% |
| 0.5 × 0.5 = 0.25 | 1.9 | 47.50% |
| | | 95.00% |

With a little effort this game can be promoted to making decision in insufficient information for the player. The player tosses a $1 coin. If it is tails, he may toss a second $1 coin and win $0.96 or lose all. If he gets heads on the first, he can take $0.95 or toss a second coin and either win $1.92 or lose a $1.

As the entertainment value of tossing the first coin is equal to the entertainment value of tossing a second coin, we had to pay the player a penny to lure him to toss the second coin instead of starting a new game. But in more complex games this is not necessary. Just the opposite, we can as well charge the player a penny or more if the entertainment value of "tossing a second coin" is greater than that of "tossing a first coin". Also in more complex games the probabilities will not be that obvious, so we will need to use more sophisticated mathematical algorithms and computers.

FIG. 1 gives the general idea of a casino game in which the player makes a decision based on insufficient information. The player starts the game at step 25 placing a bet for the first betting round (step 27). The computer displays the bet and the possible game awards for the current betting round at step 29. The player evaluates the information at step 39. He decides if he wants to raise his bet at step 41. If not, he has to decide if he will play more betting rounds at 43. If not he ends the game at this betting round and the computer pays any unpaid winnings accumulated at 47 and the game ends at step 49.

If the player chooses to play more betting rounds either by raising the bet at 41 or staying with his bet at step 43, the computer may pay or may not pay the win from the betting round at step 45. This is determined by the game designer, who will chose if the computer will pay the bet round win immediately after the completion of the betting round at step 45*a,* or the computer will accumulate the win from the bet rounds in a separate win meter at step 45*b.* The computer may also allocate the total bet (the bet accumulated in the previous betting rounds plus the bet raise for the current betting round) in respect to the probabilities of the current bet round outcomes. In each particular case this will be dictated by the entertainment value of the underlying game and its perception by the game designer but will not affect the general logic flow in the game design.

At step 31 and 35 the computer either dynamically or statically, or as a combination of both methods, evaluates the probabilities and allocates awards for the outcomes in the next betting round (in step 33 or 37 alternatively). Then the total bet and the contract for the next betting round are displayed again at step 29. This circular routine may last either until the player decides to end the game, or until a certain resource that regulates its recurrence has been reached. This may be based on a decision that the casino may not want further increases in the payout percentage due to generating excessive losses to the casino, or substantially increasing the game volatility, or a diminishing entertainment value, or encouraging compulsive gaming behavior, etc. The utilization of multiple input/output quantitative models of the game allows any set of different specification requirements to be explicitly defined as a limiting resource in the optimization model. Upon exhausting this resource the optimization algorithm will force the computer to exit the recurring game loop.

The price that the player is willing to pay in every betting round to gain access to perfect information is defined as the Expected Value of Perfect Information (EVPI) in the decision theory as set forth in Douglas Hubbard "How to Measure Anything: Finding the Value of Intangibles in Business" pg. 46, John Wiley & Sons, 2007. The problem is modeled with a payoff matrix $R_{ij}$ in which the row index i describes a choice that must be made by the player, while the column index j describes the random game outcomes of each round the player does not yet have knowledge of, determined by the probability $p_j$ of winning j. If the player is to choose i without knowing the value of j, his best choice is the one that maximizes the Expected Monetary Value (EMV):

$$EMV = \max_i \sum_j p_j R_{ij}.$$

Here $$\sum_j p_j R_{ij}.$$

is the expected payoff for action i, and $$EMV = \max_i$$

denotes choosing the maximum of these expectations for all available actions. With perfect knowledge of j, the player may choose a value of i that optimizes the expectation for that specific j. Therefore, given perfect information, the expected value is given in $$EV \mid PI = \sum_j p_j \left(\max_i R_{ij}\right),$$

where $p_j$ is the probability that the system is in state j, and $R_{ij}$ is the pay-off if one follows action i while the system is in state j. Here $$\left(\max_i R_{ij}\right),$$

indicates the best choice of action i for each state j.

The expected value of perfect information is the difference between these two quantities, $$EVPI = EV|PI - EMV.$$

This difference describes, in expectation, how much larger a value the player can hope to obtain by knowing j and picking the best i for that j, as compared to picking a value of i before j is known. Note that EV|PI is necessarily greater than or equal to EMV. That is, EVPI is always non-negative.

The first computational algorithm for the above model, the simplex method, was created by George Dantzig in 1947. Many other algorithms were developed later on with different success on speed and accuracy, but for the first time the linear programming became feasible for practical problems only in the late 80's, with the invention of the PC computers and the development of many optimization software packages like LINDA, GAMS, LP_solve etc.

The general form of the linear programming looks like:

$$\sum_{j=1}^{n} c_j x_j \rightarrow \max$$

Subject to:

$$x_j \geq 0,\ j = 1, 2, \ldots, n.$$

-continued $$\sum_{j=1}^{n} a_{ij}x_j \leq b_i,\ i = 1, 2, \ldots, m.$$

Where j stands for the pay categories to be rewarded depending on the played game, i.e. poker, slot, keno, black jack etc.

i represents the players choices, that is the betting options in every round, the hold strategies in poker, the play cards in keno and bingo, etc.;

$c_j$ represents the constant total number of outcomes in all betting rounds of the game, normally these are finite sets, but they as well could be the limit of any converging infinite mathematical function;

$x_j$ represents the unknown prizes for each betting round to be determined;

$a_{ij}$ is the matrix of probabilities for each player choice j and each possible game outcome;

$b_i$ are genuine restrictions on the players choices, for example one easily identifiable i is the players disposable income (or the bankroll as they like to call it), another one is the casino margin (obviously if the game is not profitable for the casino it will take it off the floor), in poker we can easily identify the next 32 constraints with all possible combination for 5 cards, etc.

The third major element in the game design is the physical limitation in human beings. There is an absolute time limit for us to push buttons, absorb information, react to a change and make a decision. Today's technological advances in computer hardware have made it possible for Electronic Gaming Machines ("EGM") to calculate the probabilities for multiple players choices and game outcomes faster than human limitations and the traditional duration of slot games. Using the advances in decision theory to design complex scenarios, in mathematical programming to solve them and in computer hardware and software to implement them, EGM manufacturer can design more entertaining games for the players.

The distinguished features of the present invention are described as (a) Entertainment value—players will have more choices and make decision in insufficient information.

(b) Monetary value—the player's bets and game awards in the slot game can be measured in multiple dimensions and may span over multiple consecutive games.

(c) Business value—the profit margin for the casino operator can be reliably secured by computers and mathematical algorithms.

(d) Fiscal value—the business taxes on the casino operators can be reliable assessed in complex slot games by computers and mathematical algorithms.

In a final note we will try to summarize the difference of the current invention in regard to any previous slot games. The new game design links multiple consecutive casino games in a single game through their bets and outcomes in real time. The significance of the real time is that the player can interactively build the slot game story.

We can link any kind of games, like the homogeneous games True Odds Texas Hold'Em and True Odds Razor Poker that are discussed in more detail later on, or keno and bingo. They can very well be heterogeneous if we link poker with slot and keno. The only necessary condition is that a subset of their bets and outcomes overlay. Otherwise the matrix will become diagonal and we will find ourselves playing the well known multigame EGM.

The new game design is not a mere bet change in the series of bet rounds, like the double up in poker games, the split and the insurance in Black Jack, the rescind of the initial bet in Let it Ride, the buying of reels or features in slot games, the additional bet to draw a sixth card in Second Chance Poker, etc. It is an interaction between the bets and the game outcomes in a sequence of game states. And it is interaction in real time, which implies the player chooses among the bets and the outcomes in imperfect information. This also implies that at any time the player upon his sole discretion can make a bet, skip a bet or end the game without any penalty.

DESCRIPTION OF THE PREFERRED EMBODIMENT

The exemplary embodiment of the current invention is presented by two prominent representative games in the casino slot industry, epitomizing two very distinctive classes of the casino games: skilled and non-skilled games of chance.

The first exemplary case according to this invention details the implementation in non-skilled slot games. Texas Hold 'Em surged in popularity worldwide thanks to the popularity of online poker, the promotion on television through the World Series of Poker championship and the release of major movie blockbusters by Hollywood sporting the game. But yet it had not found its match on the casino floors as an EGM. The game herein and after described is called True Odds Texas Hold'Em (TOTH'Em). It is designed to be played on a computerized slot gaming device by a single player.

One standard fifty-two card deck is used with the traditionally established poker rankings. Clearly displayed contracts (payoff schedules) are presented to the player before he places his wager. After two cards are revealed to the player, his is offered another contract with better or equal odds to wager on. The player may raise his bet, proceed to the next betting round or finish the game without raising the wager and qualifying for the awards from the contract he had bet on. Three more cards are displayed and another contract with improved odds and optional round of betting are displayed. Again, the player may raise his bet, skip to the next betting round with the placed wager and corresponding contract or simply finish the game (the showdown option). The "Turn card" is displayed and the last round of betting is offered to the play. He may raise or keep his bet with the respective contract being enforced and finish the game by displaying the last ("The River") card.

Figure 1:
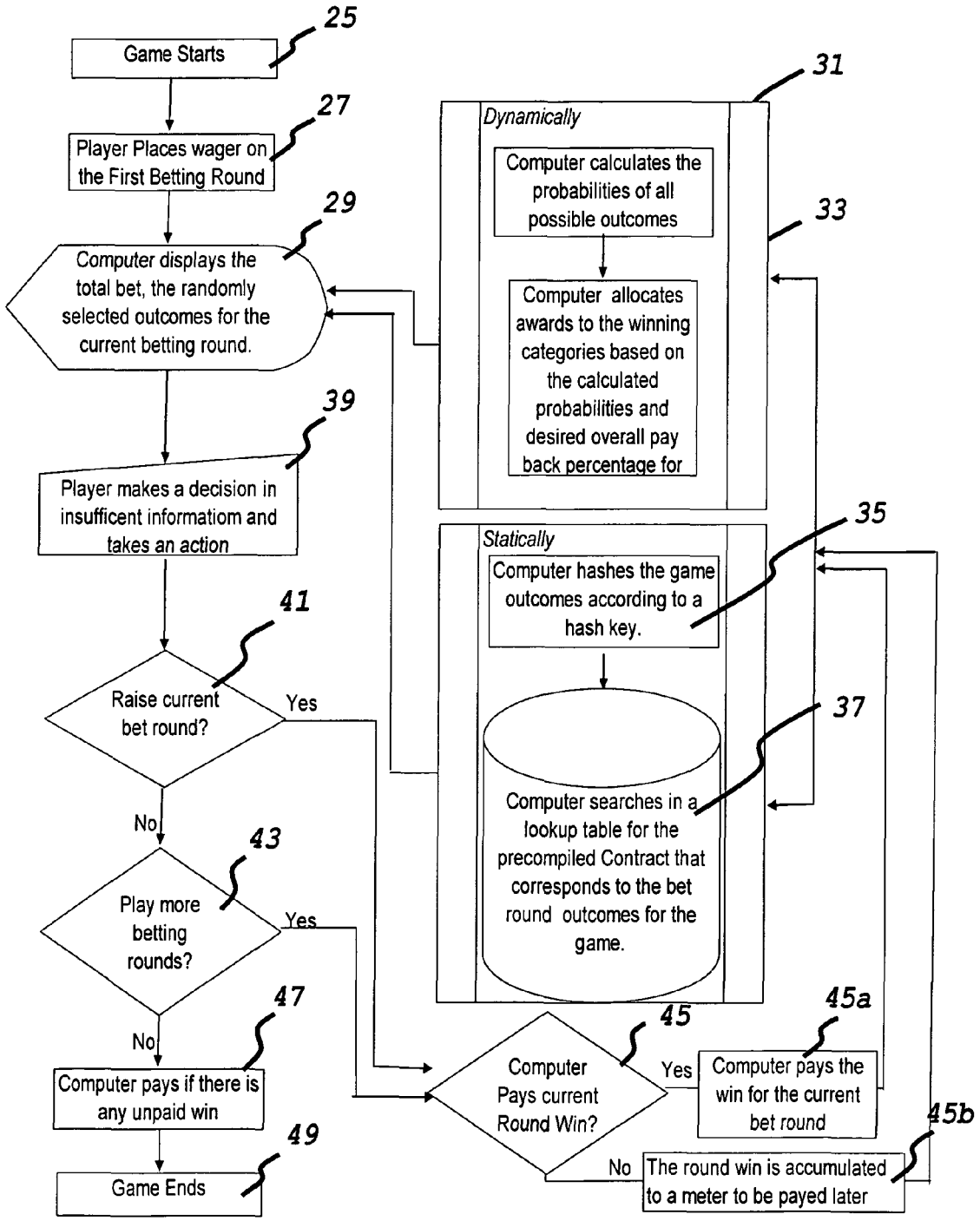
FIG. 1 is a flow chart of the new wagering casino slot game system.
Figure 2:
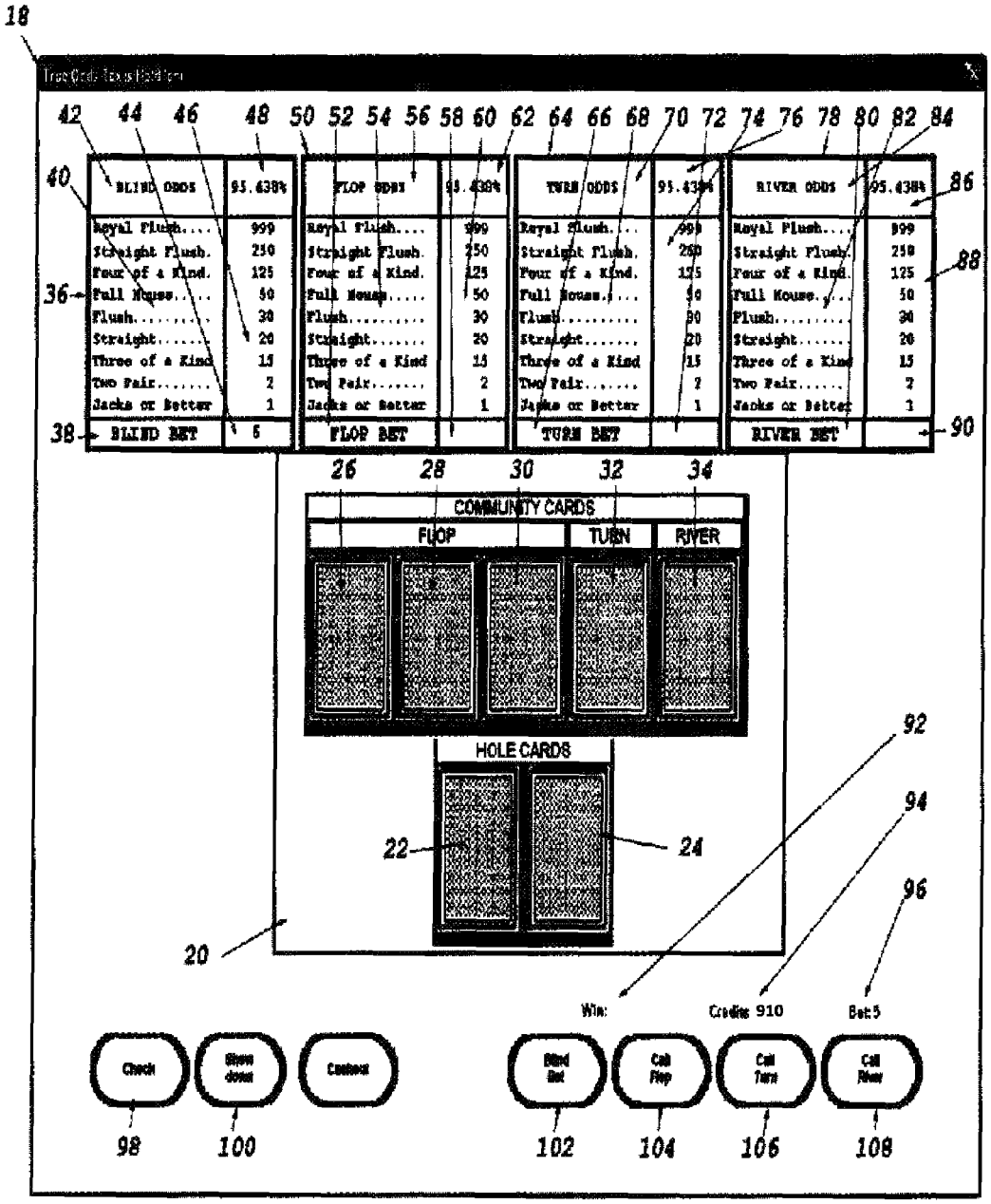
FIG. 2 is a display of the video screen after the player places his or her wager to initiate the True Odds Texas Hold'Em game.
Figure 3:
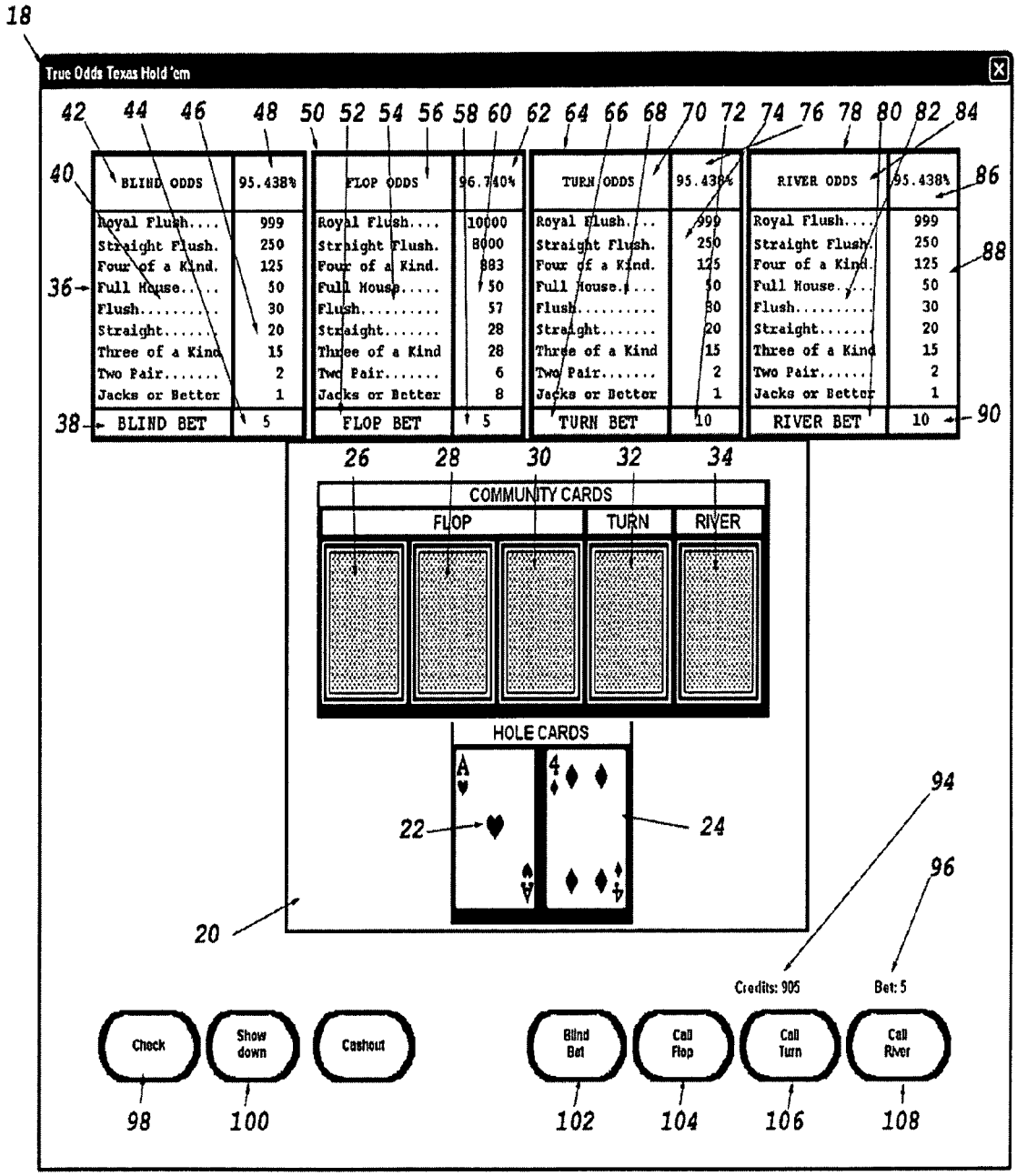
FIG. 3 is a display of the video screen after the Hole cards are dealt and displayed face up.

For better illustration of a player playing the game, reference will be made to the screen displays in combination with the flow chart illustrated in FIG. 7. A video screen 18 initially appears to the player as seen in FIG. 2. The game clears and begins at step 55. At step 57 the player places his wager on a poker hand 20. It is assumed, that the player wagers the required 5 credits called a blind bet in area 38 and displayed in area 44 for a first contract 36 to take effect. The first contract 36 is comprised of area 40 displaying the winning hands, an area 46 displaying the prizes for the winning hands, a window 42 displaying "Blind Odds" and a window 48 displaying the real odds or pay back percentage. A bet meter 96 displays the amount of the player's wager. Seven cards, 22, 24, 26, 28, 30, 32 and 34 representing a typical Texas Hold'Em Hand 20 are dealt to the player face down. At this point as there are no cards revealed and therefore there is no information on the cards value, all contracts 36, 50, 64 and 78 look exactly the same. At step 59 the game computer (not illustrated) deals the hole cards 22 and 24 face up from a randomly shuffled standard deck of cards as illustrated in FIG. 3

At step 61 the computer evaluates the probabilities of winning any of the awarded categories for the remaining 50 cards in the deck. Then it optimizes the initial bet and the required raise among all the possible prizes. It applies the general rule of the gaming industry that only the highest win pays and aims at a predetermined targeted return to the player, which is higher than the one in the first contract 36. In the optimization process the computer may employ additional criteria to generate prizes which will be attractive to the player. The second contract 50 is comprised of area 54 displaying the winning hands, an area 60 displaying the prizes for the winning hands, a window 52 displaying "Flop Bet", a window 56 displaying "Flop Odds", and a window 62 displaying the real odds or pay back percentage. The required raise of the bet is displayed in area 58. The player can depress a "Call Flop" button 104 to raise his bet and qualify for contract 50, depress a "Check" button 98 to reveal the flop cards 26-30 without raising the bet and accepting the contract 50, or simply depress a "Showdown" button 100 and reveal all cards 26-34. In the last case the amount won, if any according to the first contract 36, is displayed on a win meter 92 (shown in FIG. 6) and added to a credit meter 94.

Figure 4:
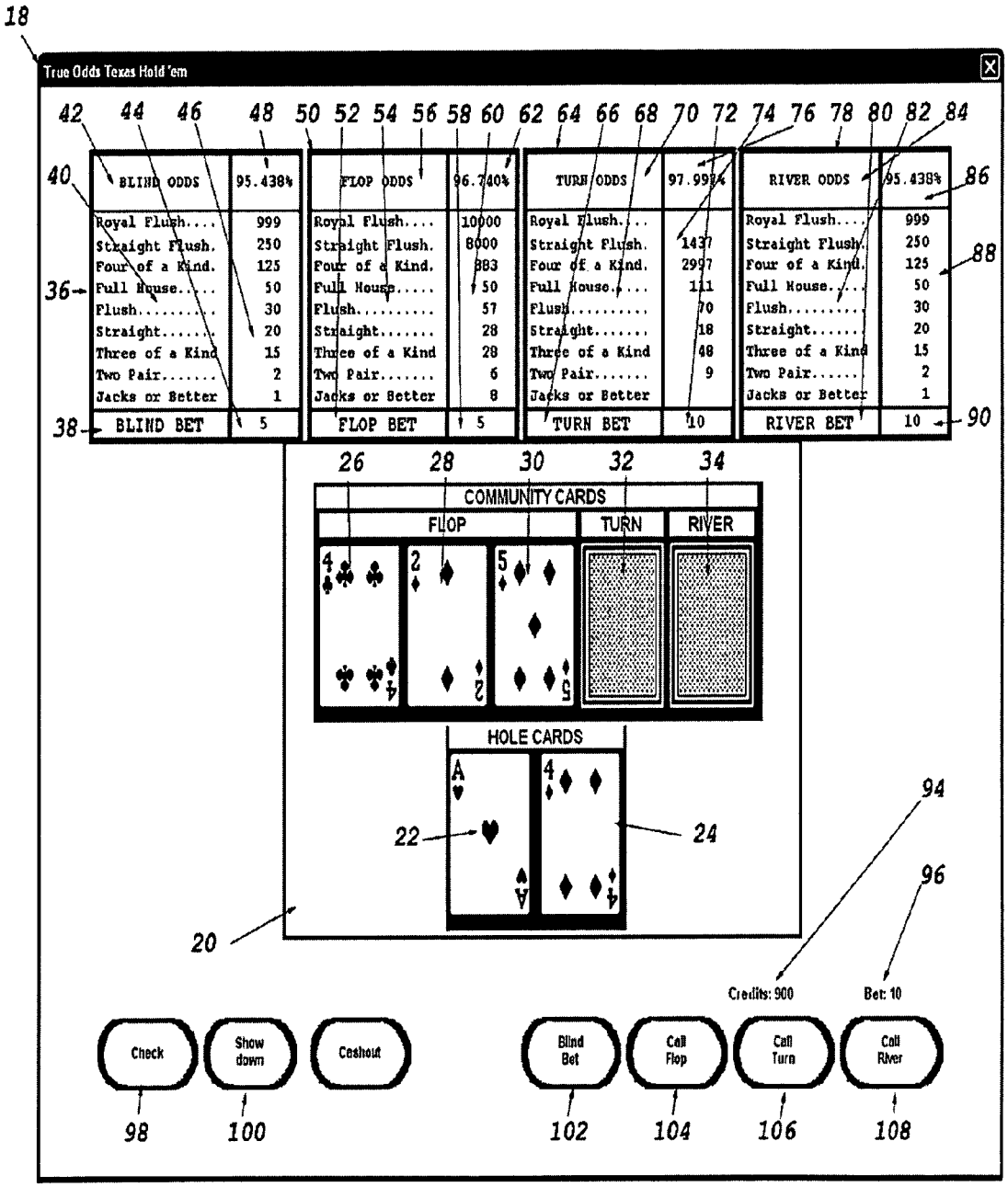
FIG. 4 is a display of the video screen after the Flop cards are displayed face up.
Figure 6:
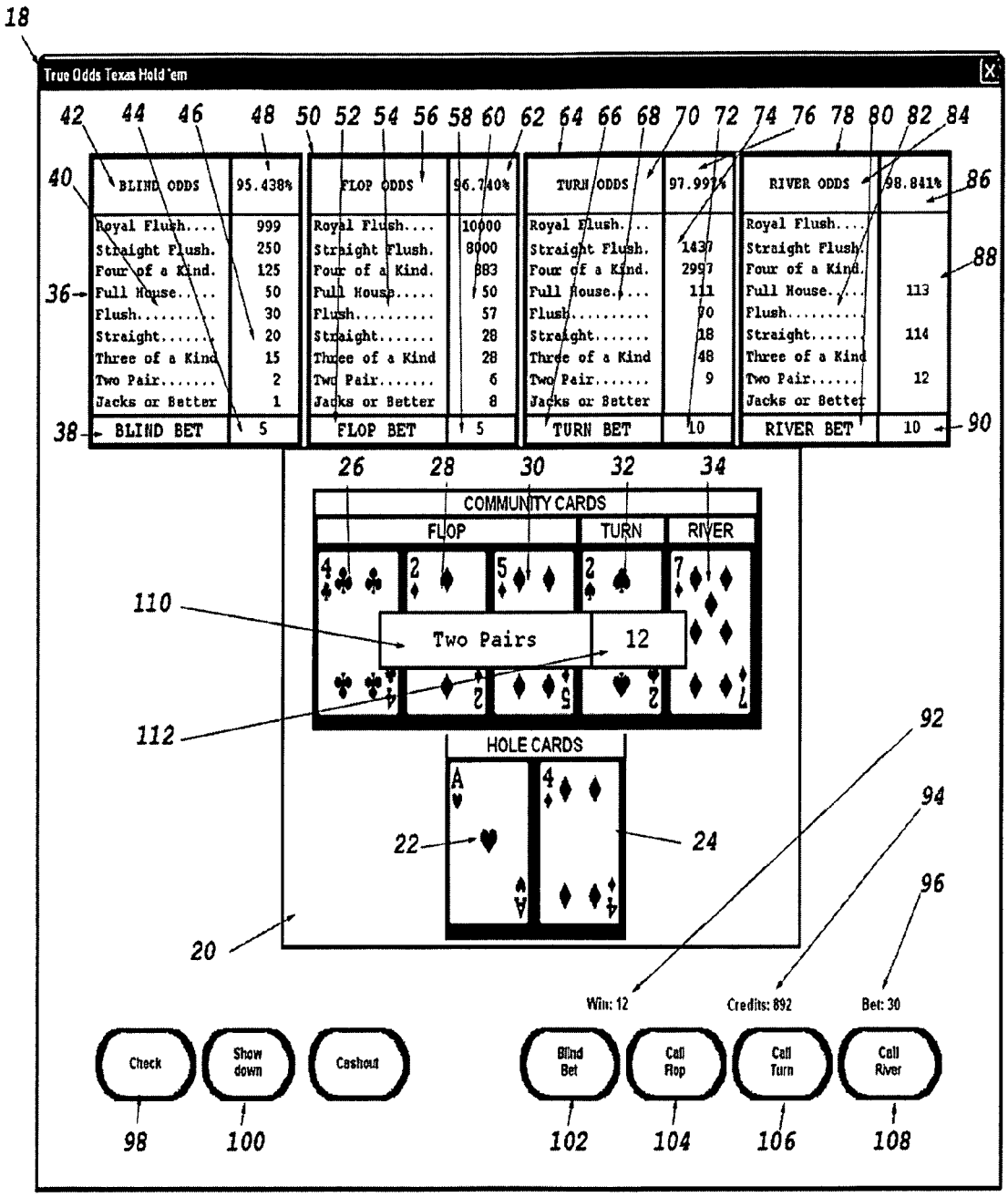
FIG. 6 is a display of the video screen after the River card is displayed face up.
Figure 7:
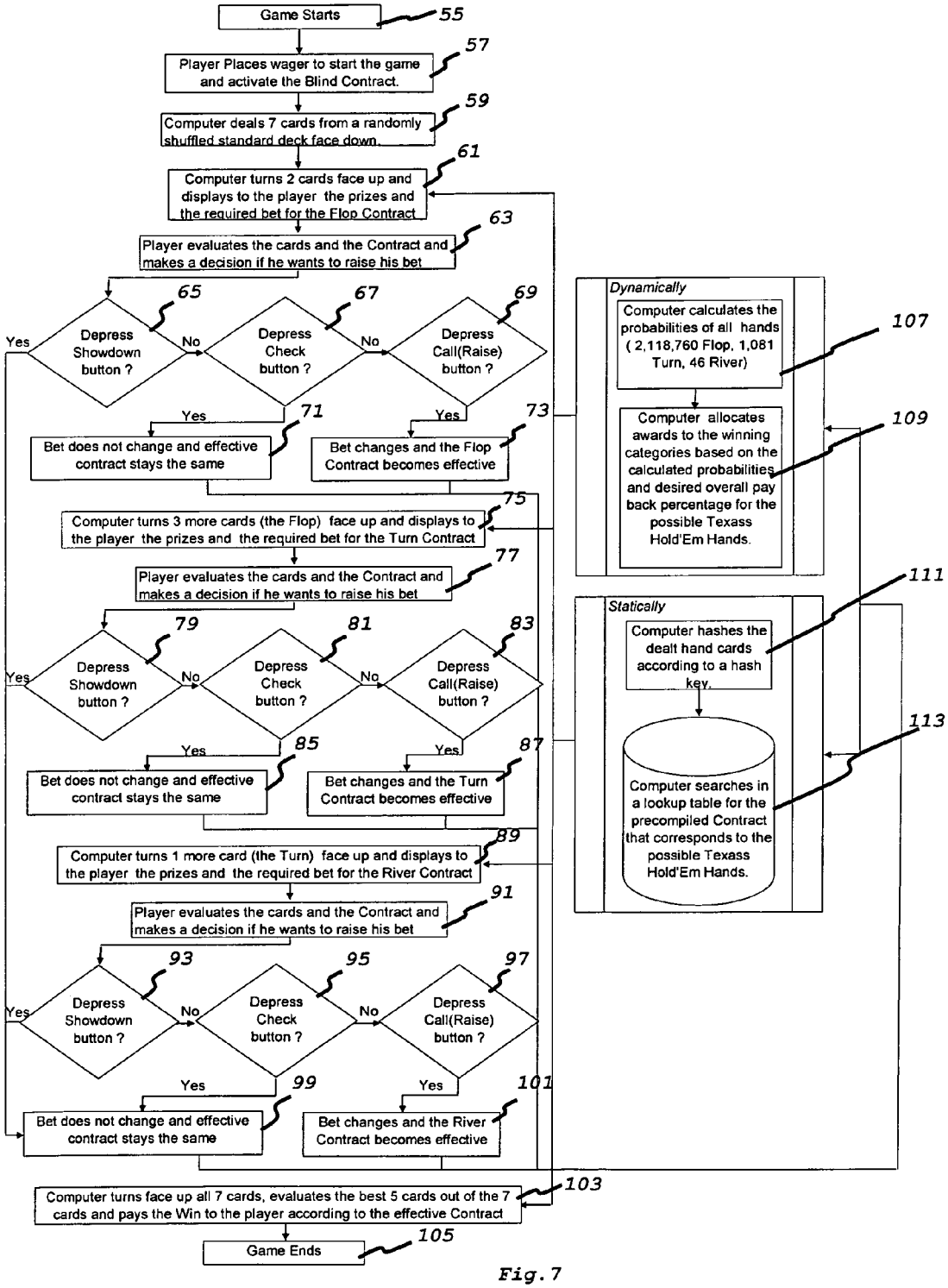
FIG. 7 is a detailed flow chart of the True Odds Texas Hold'Em game.

As seen in FIG. 4 and as described in FIG. 7, at step 75, as soon as the first round of betting is completed, the computer displays the flop cards 26-30 and evaluates the odds for the next betting round. It evaluates the probabilities of winning any of the awarded categories for the remaining 47 cards in the deck. Then it optimizes the current bet of the player and the required raise for the player to qualify for the next contract 64. All possible prizes are allocated based on the general rule in the gaming industry that only the highest win pays, and a predetermined targeted return for this betting round. This targeted return percentage is chosen to be higher than the return of the active contract to attract the player's participation in the betting process. In the optimization process the computer may employ additional criteria to generate enticing prizes to the player. The third contract 64 is comprised of area 68 displaying the winning hands, an area 74 displaying the prizes for the winning hands, a window 66 displaying "Turn Bet", a window 70 displaying "Turn Odds", and a window 76 displaying the real odds or pay back percentage. The required raise of the bet for contract 64 is displayed in area 72. The player can depress a "Call Turn" button 106 to raise his bet and qualify for contract 64, depress the "Check" button 98 to reveal the turn card 32 without raising the bet and declining contract 64 or simply depress the "Showdown" button 100 and reveal all remaining cards 32-34. The amount won, if any, according to the contract that the player qualified for, is displayed on the win meter 92 (shown in FIG. 6) and added to the credit meter 94.

Figure 5:
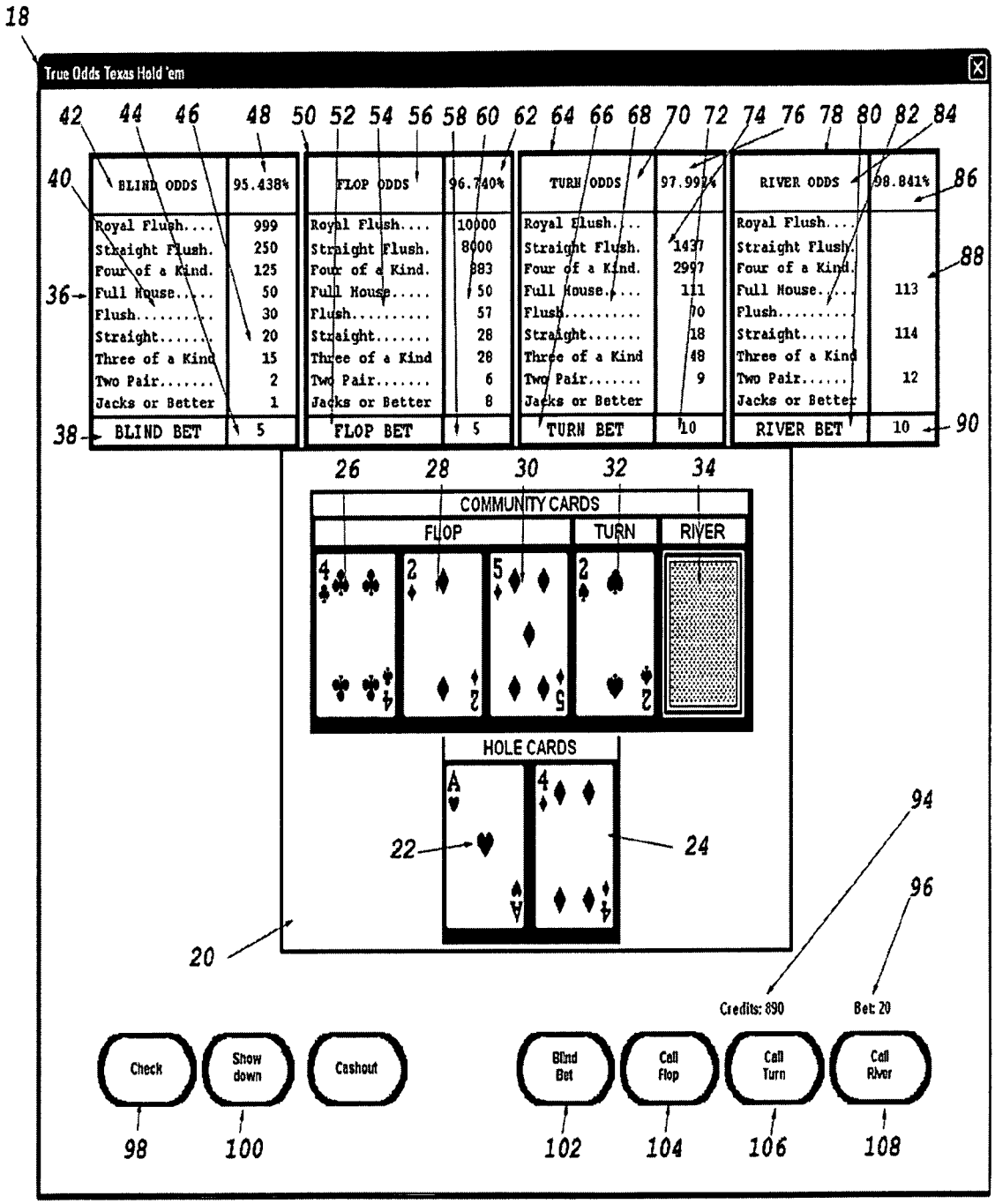
FIG. 5 is a display of the video screen after the Turn card is displayed face up.

On the next betting round as seen in FIG. 5 and as described in FIG. 7 at step 89, as soon as the second round of betting is completed, the computer displays the turn card 32 face up and evaluates the odds for the next betting round. It evaluates the probabilities of all possible winning categories for the remaining 46 cards in the deck. Then it optimizes the current bet of the player and the required raise for the player to qualify for the next contract 78. All possible prizes are allocated based on the general rule of the gaming industry that only the highest win pays and a predetermined targeted return for this betting round. This targeted return percentage is again set to be higher than the return of the active contract to further involve the player into participating in the betting process. In the optimization process the computer may employ additional criteria to generate attractive prizes to the player. The forth contract 78 is comprised of area 82 displaying the winning hands, an area 88 displaying the prizes for the winning hands, a window 80 displaying "River Bet", a window 84 displaying "River Odds", and a window 86 displaying the real odds or pay back percentage. The required raise of the bet for contract 78 is displayed in area 90. The player can depress a "Call River" button 108 to raise his bet and qualify for contract 78, depress either the "Check" button 98 or the "Showdown" button 100, which in this case is equivalent, to reveal the river card 34 without raising the bet and declining contract 78.

FIG. 6 displays the end of the game. All cards 22-34 are displayed face up. Assuming that the player has participated in all betting rounds he has "Two pairs" and has won 12 credits as displayed in area 88 according to contract 78. His prize is also displayed on the win meter 92 and added to the credit meter 94. Had the player skipped the raise for the last betting round by either depressing the "Check" button 98 or the "Showdown" button 100, the bet meter 96 would have shown 20 credits and the win meter 92 would've shown 9 credits according to contract 64.

If the player had hit the "Showdown" button 100 in the second betting round his win would be displayed as 6 credits in win meter 92 according to contract 50, but the bet meter 96 would also show only 10 credits.

Finally if the player had hit the "Showdown" button 100 in the first betting round his win would be displayed as only 2 credits in win meter 92 according to contract 36, but the bet meter 96 would also show only 5 credits.

In the described embodiment of the invention only one pocket was dealt to the player. This has been chosen for practical reasons: due to the novelty of the game the simplicity improves the clarity. But obviously there are no limits to offer more pockets to the player. It is strongly emphasized that in the general case neither the number of pockets dealt to the player, nor the offered betting schemes need to be always the same in different implementation of the game. It could very well be played with different poker categories in the contracts. The overall framework is flexible enough also to utilize different kind of decks including one or more jokers and/or different wild cards like in other currently played video poker games in the casinos.

Yet in other embodiments of TOTH'Em the player may be offered to keep any number of the initial pockets concealed and reveal them at any round with different betting schemes. In this case the entertainment aspect will be expanded by providing the player with the opportunity of evaluating different subsets of poker hands and applying different betting strategies. Such embodiments will be possible only in gaming jurisdictions which allow games of skills, but they are subject and will be discussed in more depth in the next preferred embodiment.

Figure 8:
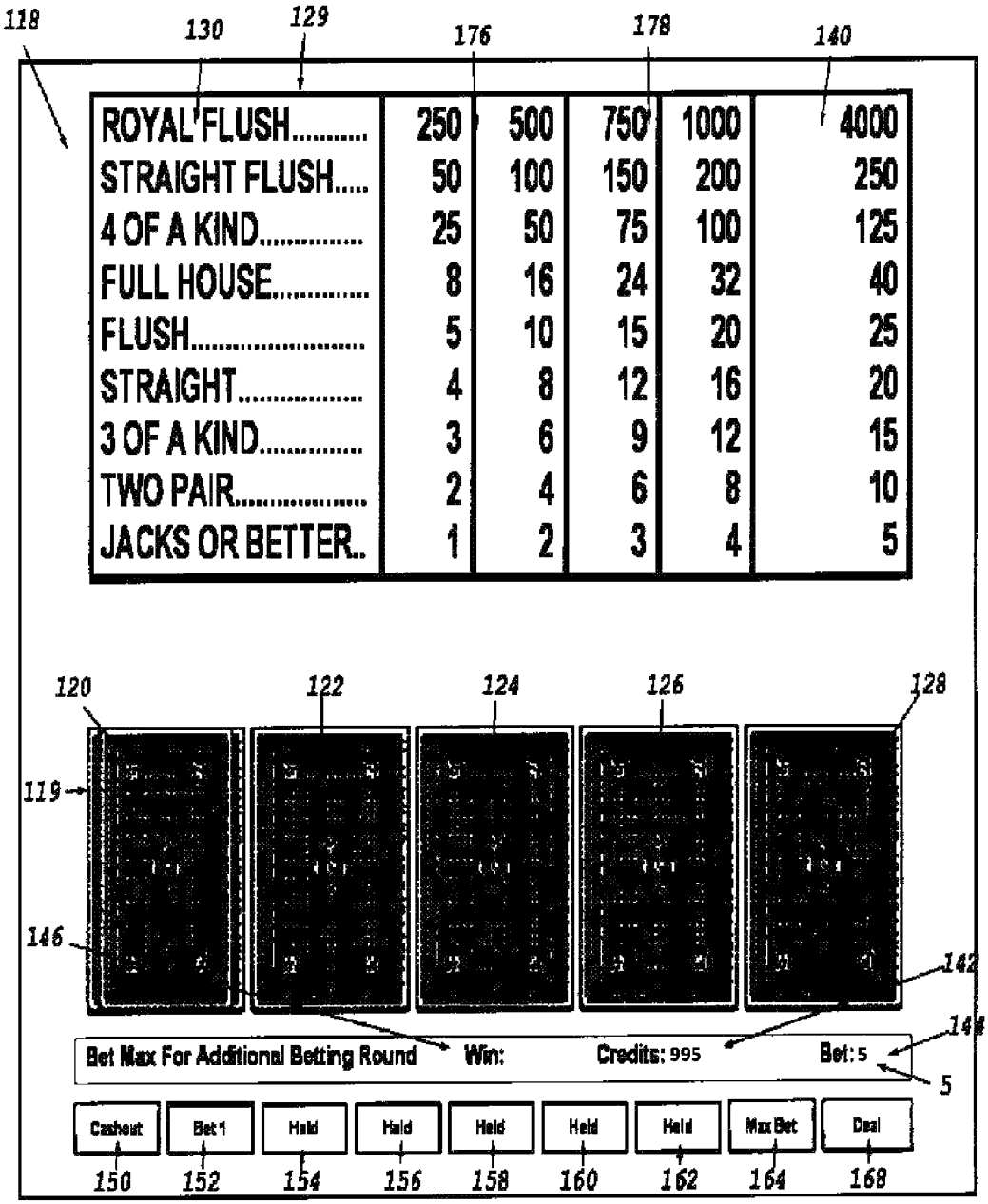
FIG. 8 is a display of the video screen after player places his or her wager to initiate the True Odds Razor Poker game.

Turning to FIG. 8, there is illustrated the second preferred embodiment of the current invention applied to skilled games. By skilled game it is implied that the ability of the player influences the final results of the game by his actions. The exemplary game hereinafter described is called True Odds Razor (TOR). The resemblance to its next to kin, the video draw poker is unmistaken.

Video monitor 118 displays a typical Video Draw Poker Hand 119 that is comprised of five cards 120, 122, 124, 126 and 128. Initially only the backs of the cards 120-128 are displayed. A genuine Jacks or Better contract 129 (Pay Table) is displayed above the Poker Hand 119. A first column 130 in contract 129 displays the names of the winning categories of the contract 129. A second column 132 displays the awards for 1 credit bet by the player, and columns three through six,134-140, display respectively the awards for 2, 3, 4 and 5 credits bet by the player. Generally the cards are dealt from "standard" fifty-two card decks which may also include jokers.

There is also displayed an area 148 which provides genuine instruction to the player during the course of the game to facilitate his actions, an area 146 to display the players win, an area 142 to show his credits and an area 144 to display the wager. All the available controls to the player 150-168 are displayed below. Control 150 allows the player to cash out his credits. Control 152 allows the player to bet one credit. Controls 154-162 allow the player to hold or discard respectively cards 120-128. Control 164 allows the player to bet the maximum allowable wager. Control 168 instructs the game to deal the cards.

Figure 9:
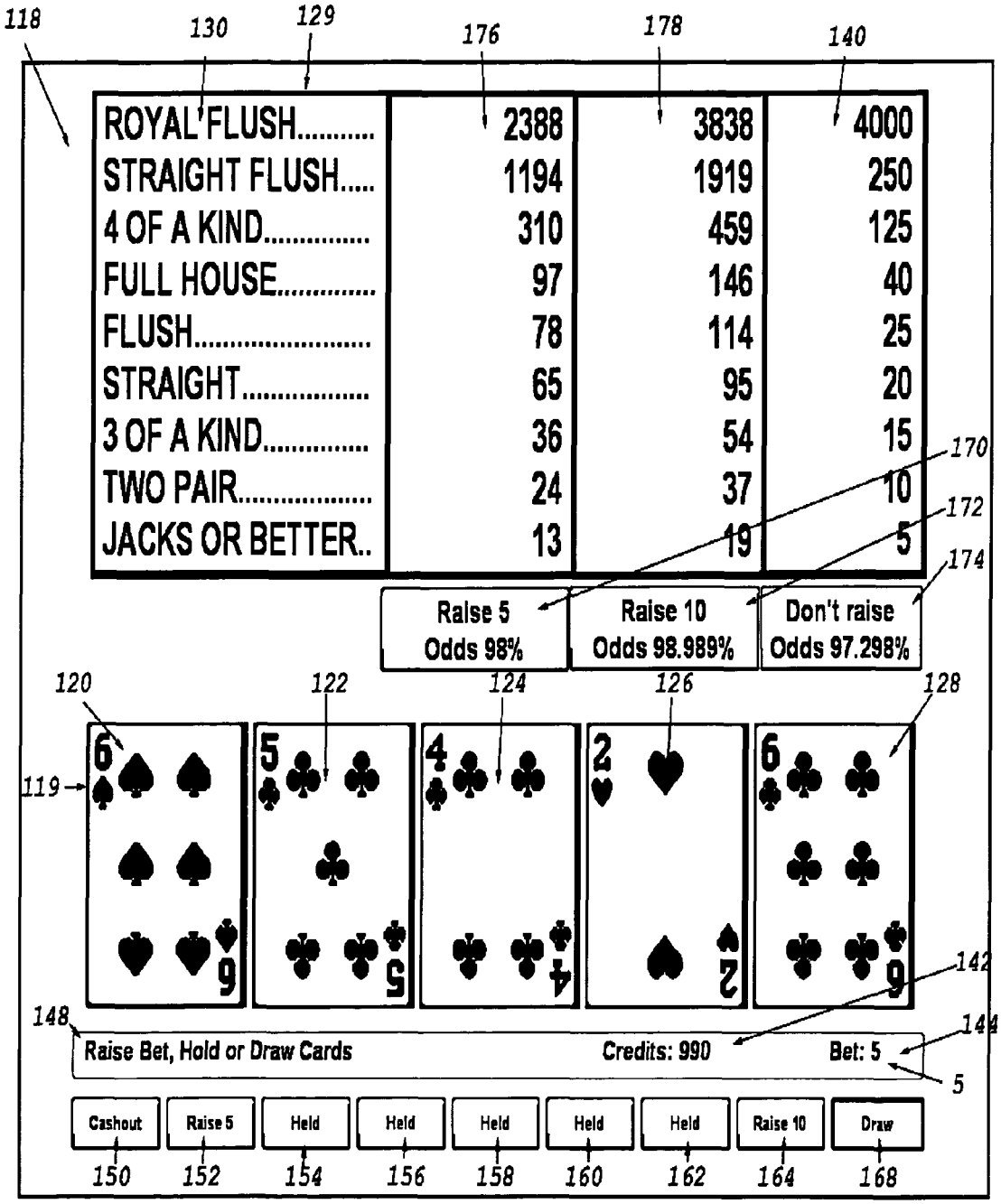
FIG. 9 is a display of the video screen after 5 randomly selected cards are turned faced up And the computer has evaluated and displayed the contracts for the bet raise.

For better illustration of game flow a reference will be made to the screen displays in combination with the flow chart illustrated in FIG. 13. The video screen 118 initially appears to the player after he places his wager as seen in FIG. 8. The game starts at step 155 in FIG. 13. At step 157 the player places his wager on the poker hand 119. It is assumed, that the player wagers 5 credits which is displayed in area 144 of FIG. 8. At step 159 the game computer (not illustrated) deals the five cards 120-128 face up from a randomly shuffled standard deck of cards as illustrated in FIG. 9.

Figure 13:
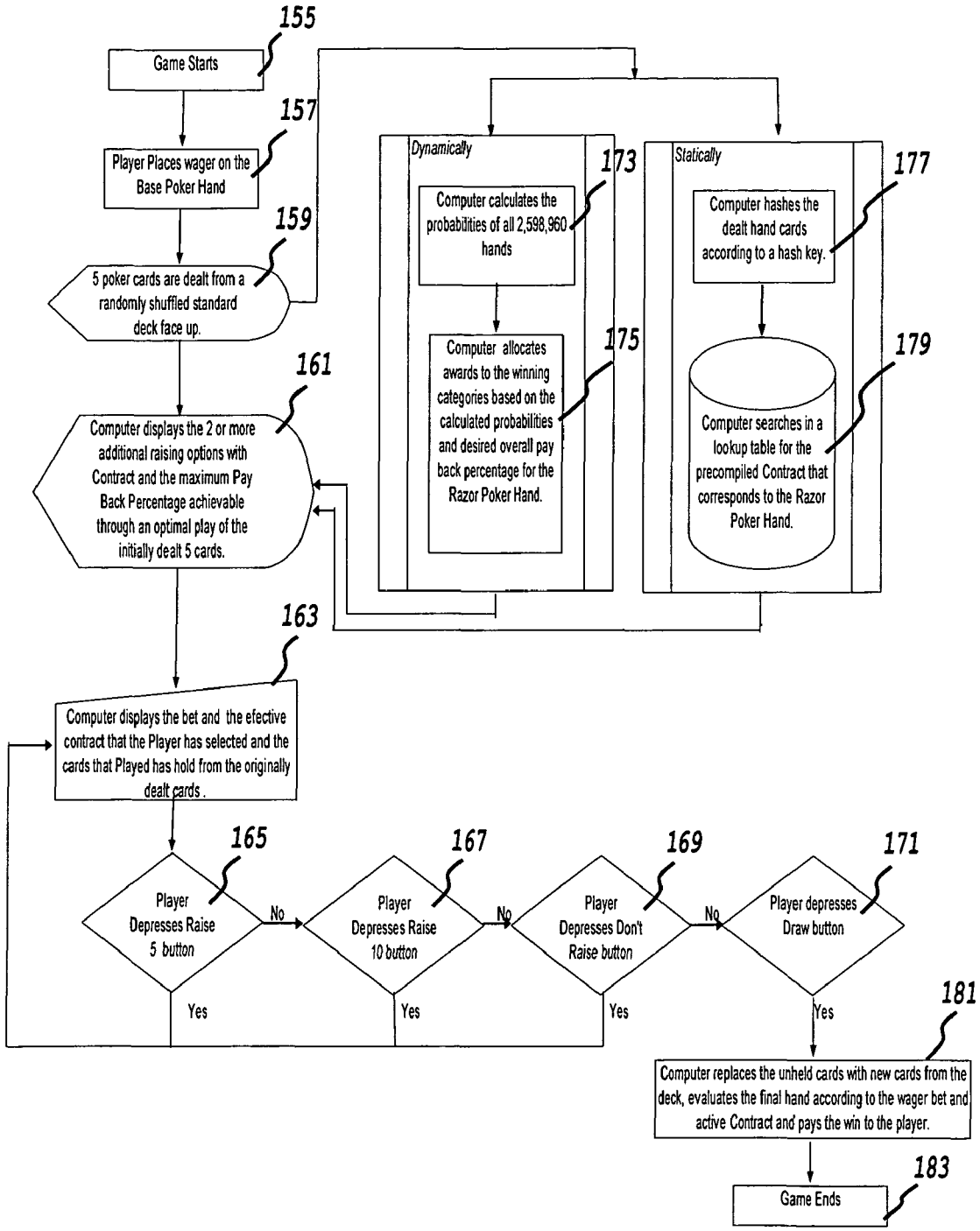
FIG. 13 is a detailed flow chart of the True Odds Razor Poker game.

As described in FIG. 13, at step 159, as soon as the poker hand 119 is determined, the computer starts evaluating all possible 2,598,960 combinations in all possible permutations of the remaining 47 cards in the deck and all possible 32 combinations, in which the initial five cards 120-128 can be held, to calculate the probabilities of the winning categories as seen at step 173. Utilizing a powerful central processing unit ("CPU") and fast poker evaluation algorithms the CPU allocates awards to the winning categories at step 175. In step 177 and 179 is shown an alternative approach, in which the computer had pre-calculated and stored all contracts in a lookup table for faster retrieval. At step 161the computer displays the two or more raising options and their contracts and the maximum pay back percentages achievable through an optimal play of the initially dealt five cards 120-128. At step 163, the player holds any of the originally displayed five cards 120-128 face up by depressing hold buttons 154, 156, 158, 160, and 162. In FIG. 9 the video screen 118 displays in areas 176 and 178 an overlay of columns 132-138 of FIG. 8 exemplary contracts to the player if he opts to raise his bet.

Figure 10:
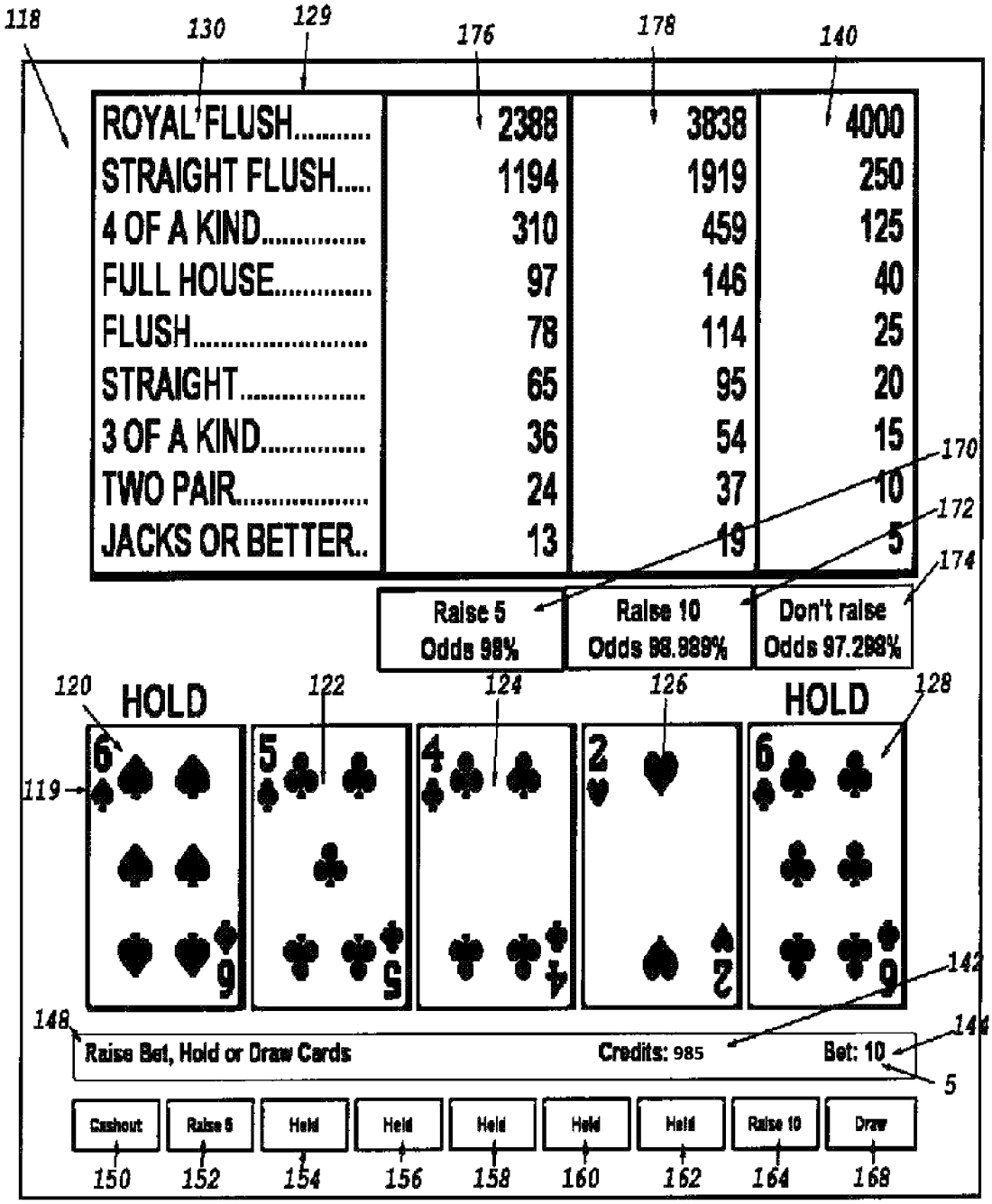
FIG. 10 is a display of the video screen after the player has chosen to raise his bet by 5 credits to 10 credits.
Figure 11:
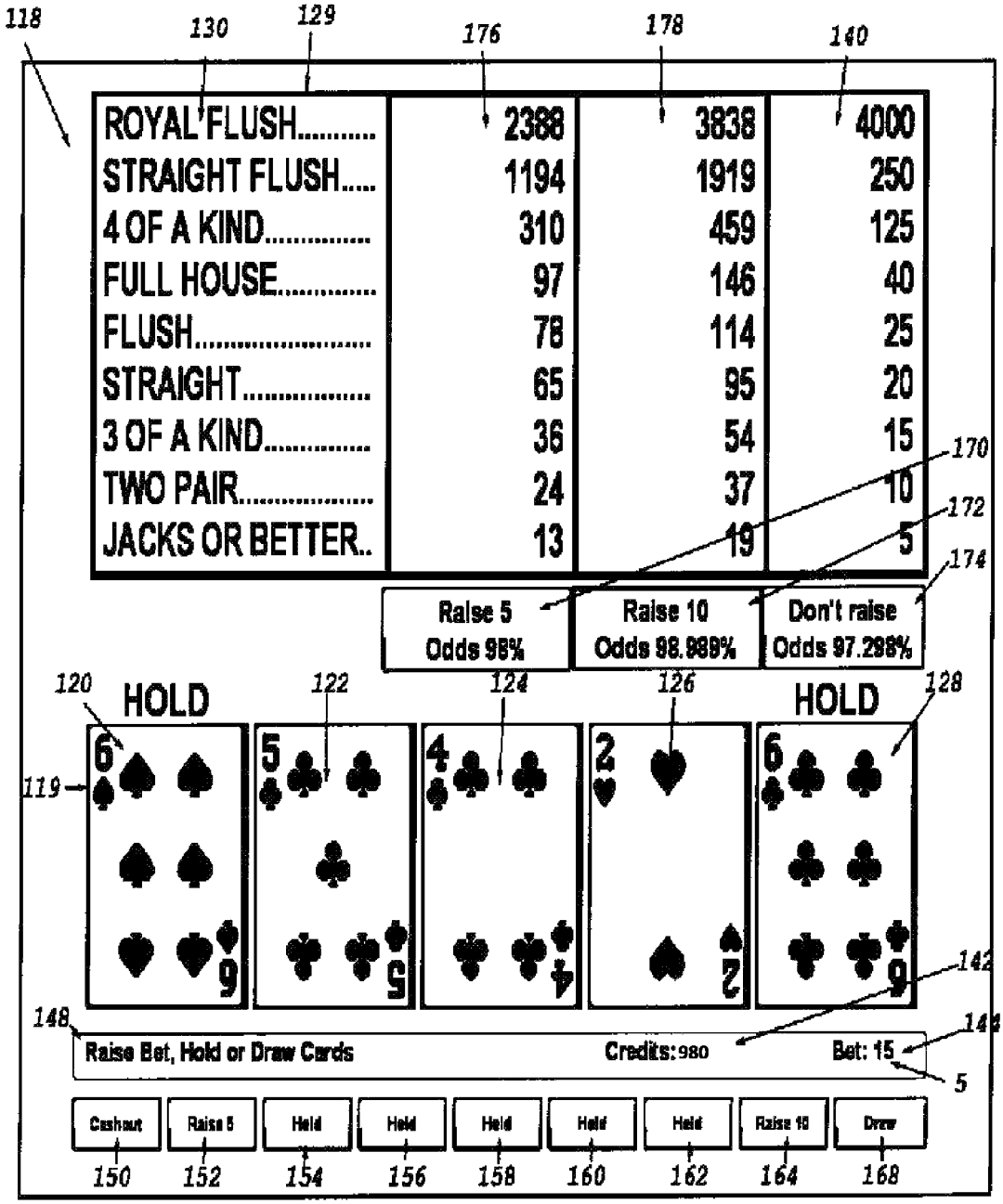
FIG. 11 is a display of the video screen after the player has chosen to raise his bet by 10 credits to a total of 15 credits.

At steps 165 and 167 the player can raise his initial bet by 5 or 10 as shown in FIG. 10 and FIG. 11. His total wager is not committed yet and is displayed in area 144, therefore it is not subtracted from his credits as displayed in area 142 until he makes his final decision. Evaluating his option as displayed by the original contract in area 140 or the raised bet contracts in areas 176 and 178, he can change the hold of the originally dealt cards 120-128, or defaults to his original contract. Below the columns are clearly displayed the required raise amounts in area 170 and 172 and the maximum pay back percentage achievable through an optimal play of the initially dealt poker hand by these contracts. The player can activate those contracts either by controls 152 or 164 on FIG. 10 or by touching areas 170 or 172 on a touch screen. Area 174 provides to the player an option to revoke his raise and return to his initial wager and default contract by touching it, which corresponds to step 169 in FIG. 13. Once the player has decided which cards he wants to hold and which contract he wants to play, he can then depresses the draw button 168 at step 171. Then the computer commits the wager and proceeds by replacing the cards that are not held with new cards from the randomly shuffled deck as seen in FIG. 12.

Figure 12:
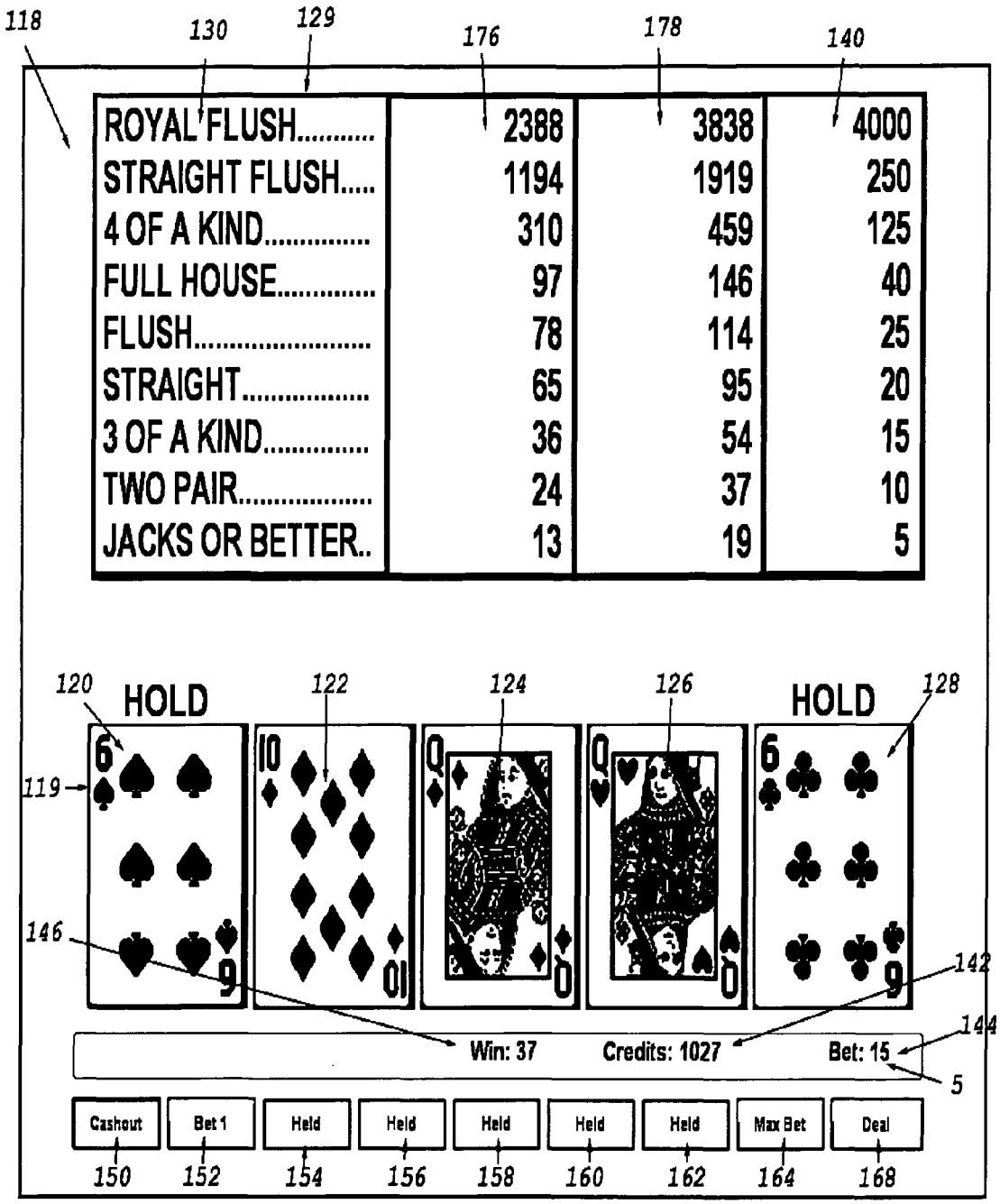
FIG. 12 is a display of the video screen of the final hand after the player has chosen to deal and replace the unheld cards with random cards from the deck.

Assuming that the player has raised his wager by 10 credits, his bet is 15 as displayed in area 144 in FIG. 12. His total credits had been reduced from 990 to 980 (not shown) by the amount of his additional raise. The unheld cards 122-126 had been replaced by new cards. At step 181 the computer evaluates that the player has Two Pair in his final hand. In this particular case the amount won is 37 credits according to contract 178. It is displayed in payout window 146 and is added to the player's credits in the amount of 1027 as shown in window 142 (990−10+37=1017). Should the player have risen by 5 credits, the bet in area 144 would've shown 10 credits. Then contract 176 would take effect and the computer would pay 24 credits. Finally, if the player had chosen to forfeit any raise option the bet in area 144 would've shown at the original value of 5 and the computer would've paid 10 credits according to the original contract 140.

As described above, the specific application was described as a form of poker. However, other games can be played such as keno, blackjack, slots or other games which are generally found at casinos.

Thus there has been provided a casino game and wagering system that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A video poker game comprising:

means for allowing a player to place a wager on a poker hand;

a video display screen for displaying the poker hand of at least five cards face up from a standard deck;

means for displaying a first pay table on the video screen;

means for calculating a second pay table based on the probabilities of all possible hands that may be obtained from discarding none, one or more of the poker hand's at least five cards, and replacing them with new cards from the deck;

means for displaying the second pay table on the video screen;

means for allowing the player to increase the wager on the poker hand a first amount after the player has observed the second pay table;

player input means for allowing the player to select none, one or more of the face up cards from the poker hand as cards to be held;

means for discarding from the poker hand those cards not selected and replacing the non selected cards with face up cards from the deck;

means for calculating a third pay table based on the probabilities of all possible hands that may be obtained from discarding none, one or more of the poker hand's at least five cards, and replacing them with new cards from the deck;

means for displaying the third pay table on the video screen;

means for allowing the player to increase the wager on the poker hand a second amount greater than the first amount after the player has observed the third pay table; and means for determining the poker hand and awarding the player an amount based on the first pay table if the player did not increase the wager and an amount based on the second pay table if the player did increaser the wager the first amount and an amount based on the third pay table if the player increased the wager the second amount.

2. The video poker game of claim 1 wherein the first pay table is based on the odds of obtaining a pair of jacks or better, two pairs, three of a kind, straight, flush, full house, four of a kind, straight flush and royal flush.

3. The video poker game of claim 2 wherein the second pay table is based on the odds of obtaining a pair of jacks or better, two pairs, three of a kind, straight, flush, full house, four of a kind, straight flush and royal flush.

4. The video poker game of claim 3 wherein the second pay table awards a better return than the first pay table for similar hands.

5. The video poker game of claim 1 and further providing means for displaying on the video display screen a payback percentage for each possible poker hand based on the application of a mathematical optimization method that calculates the probabilities of all winning poker hands and provides the pay back percentage to the player based upon the mathematical optimization method used.

6. The video poker game of claim 5 wherein the pay back percentage for the poker hand in which the player increased the wager by the first amount is greater than the pay back percentage for the same hand when the player did not increase the wager the first amount.

7. The video poker game of claim 1 and further providing means for displaying on the video display screen a payback percentage for each possible poker hand based on the application of a mathematical optimization method that calculates the probabilities of all winning poker hands and provides the pay back percentage to the player for the first, second and third pay tables, based upon the mathematical optimization method used.

8. The video poker game of claim 7 wherein the pay back percentage for the third pay table is greater than the pay back percentage for the second pay table which is greater than the pay back percentage for the first pay table.

9. A video poker game comprising:

means for allowing a player to place a wager on a poker hand;

a video display screen for displaying at least two cards of the poker hand face up from a standard deck;

means for displaying a first pay table on the video screen;

means for calculating a second pay table based on the probabilities of all possible hands that may be obtained from additional cards drawn from the deck;

means for displaying the second pay table on the video screen;

means for allowing the player to increase the wager on the poker hand a first amount after the player has observed the second pay table;

means for displaying up to three additional cards from the deck which can be combined with the at least two cards to form a poker hand;

means for calculating a third pay table based on the probabilities of all possible hands that may be obtained from additional cards drawn from the deck;

means for displaying the third pay table on the video screen;

means for allowing the player to increase the wager on the poker hand a second amount greater than the first amount after the player has observed the third pay table; and means for determining the poker hand and awarding the player an amount based on the first pay table if the player did not increase the wager and an amount based on the second pay table if the player did increaser the wager the first amount and an amount based on the third pay table if the player increased the wager the second amount.

10. The video poker game of claim 9 wherein the first pay table is based on the odds of obtaining a pair of jacks or better, two pairs, three of a kind, straight, flush, full house, four of a kind, straight flush and royal flush.

11. The video poker game of claim 10 wherein the second pay table is based on the odds of obtaining a pair of jacks or better, two pairs, three of a kind, straight, flush, full house, four of a kind, straight flush and royal flush.

12. The video poker game of claim 11 wherein the second pay table awards a better return than the first pay table for similar hands.

13. The video poker game of claim 9 and further providing means for displaying on the video display screen a payback percentage for each possible poker hand based on the application of a mathematical optimization method that calculates the probabilities of all winning poker hands and provides the pay back percentage to the player based upon the mathematical optimization method used.

14. The video poker game of claim 13 wherein the pay back percentage for the poker hand in which the player increased the wager by the first amount is greater than the pay back percentage for the same hand when the player did not increase the wager the first amount.

15. The video poker game of claim 9 and further providing means for displaying on the video display screen a payback percentage for each possible poker hand based on the application of a mathematical optimization method that calculates the probabilities of all winning poker hands and provides the pay back percentage to the player for the first, second and third pay tables, based upon the mathematical optimization method used.

16. The video poker game of claim 15 wherein the pay back percentage for the third pay table is greater than the pay back percentage for the second pay table which is greater than the pay back percentage for the first pay table.

17. The video poker game of claim 9 and further comprising:

means for calculating a fourth pay table based on the probabilities of all possible hands that may be obtained from drawing and displaying a second additional card from the deck;

means for displaying the fourth pay table on the video screen;

means for allowing the player to increase the wager on the poker hand a third amount greater than the second amount after the player has observed the fourth pay table; and means for determining the poker hand and awarding the player an amount based on the first pay table if the player did not increase the wager and an amount based on the second pay table if the player did increaser the wager the first amount, an amount based on the third pay table if the player increased the wager the second amount, and an amount based on the fourth pay table if the player increased the wager the third amount.

18. The video poker game of claim 17 and further providing means for displaying on the video display screen a payback percentage for each possible poker hand based on the application of a mathematical optimization method that calculates the probabilities of all winning poker hands and provides the pay back percentage to the player for the first, second, third and fourth pay tables, based upon the mathematical optimization method used.

19. The video poker game of claim 18 wherein the pay back percentage for the fourth pay table is greater than the pay back percentage for the third pay table which is greater than the pay back percentage for the second pay table which is greater than the pay back percentage for the first pay table.

20. A method of playing a video poker game comprising:

a player making a wager on a poker hand;

displaying at least two cards of the poker hand face up from a standard deck on a video screen;

displaying a first pay table on the video screen;

calculating a second pay table based on the probabilities of all possible hands that may be obtained from one or more additional cards drawn from the deck;

displaying the second pay table on the video screen;

allowing the player to increase the wager on the poker hand a first amount after the player has observed the second pay table;

displaying up to three additional cards from the deck which can be combined with the at least two cards to form a poker hand;

calculating a third pay table based on the probabilities of all possible hands that may be obtained from drawing and displaying one further additional card from the deck;

displaying the third pay table on the video screen;

allowing the player to increase the wager on the poker hand a second amount greater than the first amount after the player has observed the third pay table;

displaying the one further additional card from the deck which can be combined with the other displayed cards to form a poker hand;

determining the poker hand and awarding the player an amount based on the first pay table if the player did not increase the wager and an amount based on the second pay table if the player did increaser the wager the first amount and an amount based on the third pay table if the player increased the wager the second amount.

21. The method of claim 20 and further providing the pay back percentage for the third pay table is greater than the pay back percentage for the second pay table which is greater than the pay back percentage for the first pay table.

22. The video poker game of claim 21 and further comprising:

calculating a fourth pay table based on the probabilities of all possible hands that may be obtained from drawing and displaying a further second additional card from the deck;

displaying the fourth pay table on the video screen;

allowing the player to increase the wager on the poker hand a third amount greater than the second amount after the player has observed the fourth pay table;

displaying the further second additional card from the deck which can be combined with the other displayed cards to form a poker hand; and determining the poker hand and awarding the player an amount based on the first pay table if the player did not increase the wager and an amount based on the second pay table if the player did increaser the wager the first amount, an amount based on the third pay table if the player increased the wager the second amount, and an amount based on the fourth pay table if the player increased the wager the third amount.

* * * * *